US005425413A

United States Patent [19]

Miliaras

[11] Patent Number: 5,425,413

[45] Date of Patent: Jun. 20, 1995

[54] METHOD TO HINDER THE FORMATION AND TO BREAK-UP OVERHEAD ATMOSPHERIC INVERSIONS, ENHANCE GROUND LEVEL AIR CIRCULATION AND IMPROVE URBAN AIR QUALITY

[76] Inventor: Emmanuel S. Miliaras, 12 Mount Pleasant St., Winchester, Mass. 01890

[21] Appl. No.: 69,425

[22] Filed: Jun. 1, 1993

[51] Int. Cl.[6] ..... F28F 13/12

[52] U.S. Cl. ..... 165/122; 454/1; 454/16; 454/42

[58] Field of Search ..... 454/1, 42, 16; 165/122

[56] References Cited

U.S. PATENT DOCUMENTS

| | | | |
|---|---|---|---|
| 2,573,004 | 10/1951 | Frank | 237/16 |
| 3,008,402 | 11/1961 | Boulet | 454/1 |
| 3,131,865 | 5/1964 | Roe | 237/16 |
| 3,489,072 | 1/1970 | Secor | 424/42 |
| 3,918,518 | 11/1975 | Jones | 165/122 |
| 4,095,514 | 6/1978 | Roy et al. | 454/42 |
| 4,742,864 | 5/1988 | Duell et al. | 165/122 |

OTHER PUBLICATIONS

G. Spurr "The Penetration of Atmospheric Inversions by Hot Plumes", Journal of Meteorolgy, vol. 16, Feb. 1959 (pp. 30–37).

D. H. Brown & H. J. Sneck "Cooling Tower Plume Rise" Combustion, Nov. 1974, pp. 31–33.

*Primary Examiner*—A. Michael Chambers

[57] ABSTRACT

Disclosed is a method for hindering the formation and for penetrating and breaking-up overhead atmospheric inversions, enhancing ground level air circulation and, improving urban air quality and transporting ozone to the upper atmospheres by the use of waste heat, including combustion gases, rejected to the atmosphere during power generation.

3 Claims, 1 Drawing Sheet

Figure 1:
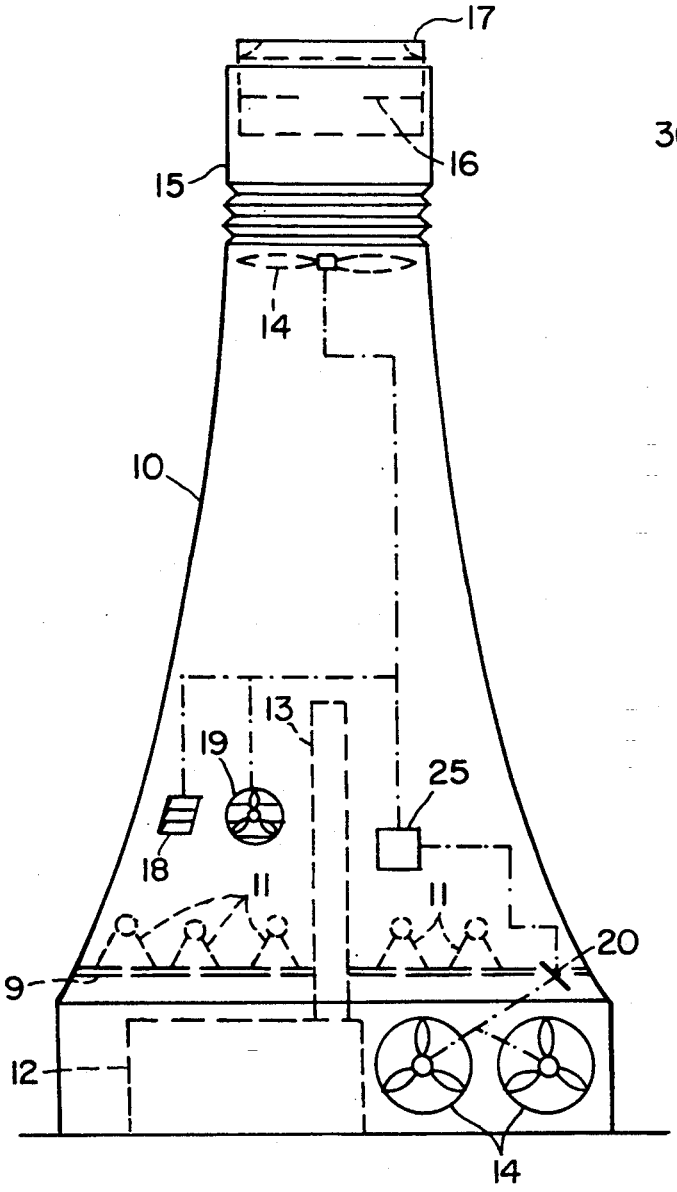

METHOD TO HINDER THE FORMATION AND TO BREAK-UP OVERHEAD ATMOSPHERIC INVERSIONS, ENHANCE GROUND LEVEL AIR CIRCULATION AND IMPROVE URBAN AIR QUALITY

FIELD OF INVENTION

The invention concerns the application of waste heat, including combustion gases, rejected to the atmosphere during power generation, to penetrate and break-up overhead atmospheric inversions, enhance air circulation at ground level, and, improve urban air quality and transporting ozone to the upper atmospheres.

More specifically, the invention concerns a method to apply the heat rejected from power plants to the atmosphere through cooling towers, preferably of the natural draft (hyperbolic) type and mixed with the hotter combustion gases from the same power plant. The invention also includes means to vary the velocity, diameter, buoyancy and direction of the resulting plume and the surrounding air that it will entrain, to better accomplish the desired results.

BACKGROUND OF THE INVENTION

In many of the world's major cities atmospheric thermal inversions frequently trap air pollutants near ground level, resulting in poor ground-level air quality. There are no known practical means to address this immediate problem and alleviate poor air quality due to atmospheric inversions in large cities. (Long term measures include improved emission controls on automotive and industrial sources of pollutants).

As severe air pollution incidents in the affected cities become more frequent, industrial and transportation activities are curtailed and schools close for the duration of the emergency. A variety of impractical and very costly measures are currently being proposed to alleviate ground level pollution without any assurance of their effectiveness. For example, Mexico City is considering two huge cuts in the mountains that border the city for the polluted air to escape through. Another proposed scheme calls for the installation of several giant fans, spaced at intervals over a considerable distance, to move the polluted ground level air away from the city. Both these impractical schemes underscore the general principle that large expense of energy will be required to disperse polluted urban air trapped by inversions, either expended once—to modify the terrain, or over time, through the use of fans.

Around the turn of the century and through the nineteen-twenties power plants were located inside city boundaries in order to reduce transmission losses, and also so that the waste heat from the condensing steam could be used in local downtown 'district heating' networks, prevalent at the time. Such use of the waste heat greatly improved overall fuel utilization by these early, inefficient power plants. Later on, power plants became associated with noise, unsightliness and pollution and were sited away from cities. Power plants can now be built with much improved environmental performance than in the past, making them acceptable for siting in cities always in need of power, particularly if they can also contribute to improved air quality.

It has been known that plumes of combustion gases emanating from tall stacks serving large power plants will penetrate inversions (Spurr, in "Journal of Meteorology", Volume 16; February 1959), and that large cooling tower plumes could also penetrate inversions (Brown and Sneck, in "Combustion"; November 1974). This information was primarily used to absolve power plant combustion gases from charges that they were contributing to ground level air quality problems during periods of inversion, and absolve cooling tower plumes from causing fogging, icing and poor visibility. The use of these plumes to break-up inversions has not been contemplated and claims that the plumes could be used to improve ground level air quality have not been made. U.S. Pat. No. 3,489,072 considers the use of a light weight, collapsible, tall and buoyant waste-gas discharge stack, variously supported and deployed, only for the purpose of obtaining at low cost increased dilution and dispersion of the discharged gas.

DESCRIPTION OF THE INVENTION AND ITS OPERATION

The present invention will utilize the large quantities of the free energy available in power plant waste heat and combustion gases, strategically located and dispersed, to hinder the formation of atmospheric inversions—and if such inversions occur to penetrate and break them up, to enhance air circulation at ground level, and to improve urban air quality.

Waste heat from power plants rejected by condensing steam (if not located by the sea, or near rivers) is usually discharged through the use of evaporative (or wet) cooling towers. However, since in most of the world's large cities suffering ground level air quality problems because of inversions water is also at a premium, the invention will use, but it will not be limited, to air-cooled (or dry) towers for waste heat rejection. The combustion gas plume is generally hot and of relatively high velocity, while the cooling tower plume is much cooler, and of lower velocity. The mass of the cooling tower plume is several times that of the combustion gas plume. By combining the waste heat leaving the steam condensing air-cooled modules with the combustion gases leaving the boiler, a larger buoyant plume will be available to penetrate inversions than if either of these plumes was used alone, thus red using the size of the power plant needed to penetrate a given inversion. However, either of these plumes alone, if large and buoyant enough, should be able to accomplish the dispersion of overhead inversions and result in ground air ventilation and air quality improvement. For example, a large-volume buoyant plume made up from combustion gases alone, such as from the exhaust of several gas turbines, can also accomplish the desired results.

Large rein forced-concrete hyperbolic shells enclosing wet or dry cooling modules have been used for waste heat rejection from steam-electric power plants for many years. Other shapes and materials have also been used, such as structures consisting of a lower section, large diameter cylinder enclosing the cooling elements and a longer, smaller diameter cylinder to create the draft, made-up of aluminum or galvanized steel, appropriately anchored and supported. Many large towers are in existence, several 300 to 500 feet in base diameter and a few over 500 feet in height. Inside the base of such a structure much of the power plant and its switch-yard can be located, together with its stack and the dry tower cooling system. The idea of placing power plants inside the shells of cooling towers is not new; however, the purpose and the intended benefits in our case are novel, and the arrangement of the components and the design of the tower shell will be specifically carried out so as to enhance ground level ventilation and the penetration and break-up of air inversions.

In order to make acceptable again the location of power plants in city environs, such plants must be environmentally benign and unobtrusive. Natural gas fired combined cycle power plants can be efficient, compact and low in emissions; they are perceived by the public as clean and quiet and could be built on top of a parking lot, a warehouse, or some other inner-city structure. The exterior of the tower shell can be used for various purposes suitable to city environs without affecting its primary use.

Although, as previously discussed, power plant and cooling tower plumes can penetrate inversions, there can be no assurance that this will result in the break-up of the overhead inversion and improved ground level air quality. The invention will accomplish these desirable goals by combining the two types of plumes into a more buoyant and energetic plume, by providing means to modify the thermal loading of the resulting plume, its height of discharge, its velocity and direction, its swirl, the amount of adjacent air that the combined plume will entrain, as well as the quantity of ground level air that will flow through the cooling tower and discharged above the inversion. These features of the invention will become obvious in the description of its operation, carried out below through the use of FIG. 1 which shows schematically several embodiments of apparatus according to this invention, together with details of its construction.

As shown in FIG. 1, a tower shell 10, not always hyperbolic in shape, encloses air-cooled condenser modules 11 located on platform 9, and all or part of power plant 12, and its stack 13; the latter arranged concentric to the shell so that in combination they can act as a jet pump. Optional fans 14, to induce or increase air flow through the cooling tower modules and the shell, are shown arranged along the base periphery of the shell and also at its exit. A collapsible, or telescoping, lightweight extension 15 of the shell, suitably anchored and supported, includes means to change the diameter of the plume's exit as well its direction. Such means include a horizontally pivoted, variable diameter aperture 16 and an inflatable nozzle-shaped torus 17 which can be used to change plume diameter as well as direction; integral to the aperture or the torus vanes (not shown) can be used to impart swirl to the plume. The said cooling modules (11) can be arranged in the periphery, or they can be elevated in the interior of the shell, as shown, for cross-flow or counter-flow air movement. When atmospheric conditions require, the collapsible section can be extended (through the use of the exiting gases, by pulling it up with tethered balloons, through the use of telescoping guide poles located at the top of the shell, or by other means. Motor operated louvers 18, along the shell's walls allow air from outside the tower to be drawn into the shell and discharged with the plume; similarly located louvered fans 19 can also introduce outside air into the shell. Adjustable vents 20 can allow some of the ground-level airflow to by-pass said condenser modules (11). Sensing and control instrumentation 25 will utilize near and remote data regarding weather and ambient air conditions to control the operation of fans, louvers, shell extension, and plume diameter, direction, swirl and buoyancy.

Figure 2:
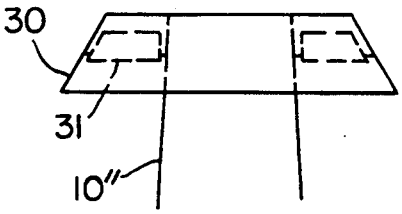

FIG. 2 shows an alternative shell-exit arrangement, where the exiting plume induces ambient air to flow upwards through an annular passage 30 around the exit of shell 10″. Fixed or variable pitch vanes 31 support this annular passage and can provide a swirl to the flow.

The operation of a large air-cooled power plant discharging its mixed plume through a tall shell will greatly contribute to ground level air circulation, while the discharging plume will be causing considerable mixing and movement of the above-the-plant air strata, hindering the formation of an inversion. For example, it has been calculated that ground level airflow near the base of a tower discharging the mixed plume of a 500 MW combined cycle power plant will, over the period of one hour, result in the evacuation of a cylindrical volume of air 30 feet high and over 2 miles in diameter around the plant, not accounting for the volume of the buildings in this space. This air will have to be replaced by more distant and cleaner air, resulting in improved ground level air quality in the vicinity of the plant. The undesirable, ozone-rich, ground level polluted air being discharged above the inversion and continuing to rise to great heights because of its buoyancy, can replenish some of the high altitude ozone losses. Indeed, the buoyant plume can be used to quickly transport intentionally generated ozone to high altitudes, thus minimizing its decomposition.

During normal weather conditions, in the absence of an overhead inversion trapping pollutants near ground level and degrading air quality, power plant operation will be carried out with a minimum number of fans operating and other equipment, such as louvers and shell exit tube extension and diameter, positioned so as to optimize power plant operation. In the presence of an inversion, or when an inversion is incipient, the operation of the power plant and the configuration of the shell and its plume will be altered to increase air flow through the tower, change the velocity and vary the direction of the plume, impart swirl to the flow and increase plume thermal loading and buoyancy, if necessary, so as to discourage the formation of the inversion, or if an inversion is formed, bring about its penetration and breakdown. Operation of the power plant and changes to the shell and plume configuration to discourage incipient inversions, or contribute to their break-up once formed can include several, or all, of the following measures:

Air flow through the shell, and ground air circulation can be increased by increasing the number of fans 14 operating along the base perimeter of the shell or at its exit, or by raising their speed, some of this increased air flow by-passing the air cooling modules by opening by-passing vents 20. Plume buoyancy and the airflow through the shell can also be increased by increasing the discharge rate of combustion gases through the stack by increasing the plant's electrical load, or by starting up additional generating equipment located within the shell, such as peaking gas turbines. The velocity of the discharged thermal plume can be increased by reducing its shell-exit diameter; the plume's discharge height can also be increased by extending its collapsible, or telescoping, section. The direction of the discharging plume can also be altered by the use of the pivoted aperture, by changes in the shape of the inflatable nozzle-shaped torus at the shell's exit, or by changing the direction of the tubular shell extension. These gradual changes in the direction of the plume exiting the shell will result in exposing a larger area of the overhead inversion to plume penetration and its destabilizing influence than if the plume was rising vertically in the calm air prevailing during inversions. The amount of ground, or near ground, polluted air to be induced into the shell and discharged above the inversion can be altered by the operation of the adjustable vents (20), and the use of the motor operated louvers (18) and the louvered fans (19) which are located at various heights on the side of the shell.

CONCLUSION, RAMIFICATIONS AND SCOPE OF INVENTION

From the above limited description of the invention and its operation, further objects and advantages as well embodiments of it should become obvious to persons skilled in the art. By utilizing buoyant plumes—usually associated with power by plants, to alleviate environmental problems resulting from industrialization and urbanization, such as poor ground level air quality and upper-atmosphere ozone layer depletion, the invention provides a low cost solution to these problems and makes good use of waste resources (power plant combustion gases and rejected heat) for which few uses have been found. Although it has been known by some that buoyant plumes from large power plants could penetrate inversions, this information has only been used to absolve power plant plumes from accusations of contributing to environmental problems during atmospheric inversions, such as poor ground level air quality from combustion gases, or to fogging from cooling tower plumes. The use of plumes from these sources, either singly or in combination, and modifications to their diameter, velocity, swirl, buoyancy, direction of the plume and amount of ambient air entrained (collectively referred to as plume characteristics) to prevent or destabilize atmospheric inversions and improve urban air quality, or transport ozone to the upper atmosphere, has not been previously contemplated. Other benefits from the invention include savings in fuel utilization (and reduced emissions), by enhancing the option of locating power plants near electric load centers; the need for transmission lines to distant power plants will also be reduced.

What I claim is:

1. A system for hindering the formation of overhead atmospheric inversions, enhancing ground level air quality, and transporting ozone to high altitudes, the system comprising:

a structure having a top extension;

said top extension including a variable aperture; and means for orientating said top extension in a number of different directions including an accordion section integral with said top extension for transporting a plurality of buoyant plumes into the atmosphere.

2. A structure for hindering the formation of atmospheric inversions, enhancing ground level air quality, and transporting ozone to high altitudes, the structure comprising:

a cooling tower shell for directing heat from condensing steam from a power plant into the atmosphere, said tower shell having an interior portion large enough to encompass at least a chimney portion of an existing power plant for discharging combustion gases from the power plant, said tower shell having a telescopic top extension;

said top extension including a variable aperture and means for orientating said top extension in a number of directions for directing a plume and modifying the shape of a plume; and means for introducing outside air into said tower shell for modifying air flow through the tower shell.

3. A structure for hindering the formation of overhead atmospheric inversions, enhancing ground level air quality, and transporting ozone to high altitudes, the structure comprising:

a cooling tower shell having an interior portion large enough to encompass at least a chimney portion of an existing power plant, said tower shell having a base portion and a telescopic top extension;

said top extension including a variable aperture for modifying the shape of a plume and an accordion section for orientating said top extension in a number of directions for directing a plume;

said tower shell including a plurality of fans and louvers for introducing outside air into the tower shell for modifying the air flow through the tower, a number of said fans being located at said base portion, said louvers and remaining fans being located between said base portion and said top extension; and a fan located within said top extension for drawing air upwards through the tower shell;

wherein outside air introduced into said tower shell is combined with output of the chimney portion, said combination being discharged through said top extension.

* * * * *